US007849919B2

(12) United States Patent
Wood et al.

(10) Patent No.: US 7,849,919 B2
(45) Date of Patent: Dec. 14, 2010

(54) METHODS AND SYSTEMS FOR GENERATING AND USING PLASMA CONDUITS

(75) Inventors: James R. Wood, Grapevine, TX (US); Mark K. Browder, Frisco, TX (US); Richard V. Shone, Grapevine, TX (US)

(73) Assignee: Lockheed Martin Corporation, Bethesda, MD (US)

( * ) Notice: Subject to any disclaimer, the term of this patent is extended or adjusted under 35 U.S.C. 154(b) by 759 days.

(21) Appl. No.: 11/812,907

(22) Filed: Jun. 22, 2007

(65) Prior Publication Data

US 2008/0314732 A1 Dec. 25, 2008

(51) Int. Cl.
*F42B 1/02* (2006.01)

(52) U.S. Cl. ..... 166/248; 166/297; 102/327

(58) Field of Classification Search ..... 166/248, 166/297; 102/327

See application file for complete search history.

(56) References Cited

U.S. PATENT DOCUMENTS

| | | | | |
|---|---|---|---|---|
| 2,799,641 | A | 7/1957 | Bell | |
| 3,507,330 | A | 4/1970 | Gill | |
| 3,874,450 | A | 4/1975 | Kern | |
| 4,084,638 | A | 4/1978 | Whiting | |
| 4,466,484 | A | 8/1984 | Kermabon | |
| 4,849,699 | A * | 7/1989 | Gill et al. | 324/339 |
| 5,054,564 | A | 10/1991 | Oestreich | |
| 5,282,508 | A | 2/1994 | Ellingsen | |
| 5,331,895 | A | 7/1994 | Bourne | |
| 6,387,207 | B1 | 5/2002 | Janakiraman et al. | |
| 6,427,774 | B2 | 8/2002 | Thomas | |
| 6,460,463 | B1 | 10/2002 | Parrott | |
| 6,523,474 | B2 | 2/2003 | Parrott | |
| 6,729,850 | B2 | 5/2004 | Dandl et al. | |
| 6,843,178 | B2 | 1/2005 | Wood | |
| 6,877,562 | B2 | 4/2005 | Bourne | |

(Continued)

FOREIGN PATENT DOCUMENTS

JP 2003317999 A 11/2003

(Continued)

OTHER PUBLICATIONS

Fowler, C.M., R.S. Caird, and W.B. Garn, An Introduction to Explosive Magnetic Flux Compression Generators, Los Alamos Scientific Labroratory of the University of California, Mar. 1975, 34 pages, Los Alamos, New Mexico.

*Primary Examiner*—William P Neuder
(74) *Attorney, Agent, or Firm*—Buchanan Ingersoll & Rooney PC

(57) ABSTRACT

Systems are disclosed for providing a plasma conduit maintaining ionized particles within a perforation hole in a body, and a power source configured to provide electrical power through the plasma conduit. Methods are disclosed for detonating a plasma generator, the detonation forming a plasma conduit within a body perforation hole, and connecting a power source to the plasma conduit, the power source configured to provide electrical power through the plasma conduit. Systems are also disclosed for generating a plasma conduit. The system includes two or more explosive devices containing ionizable material, and the explosive devices are adapted to, upon detonation, form a plasma conduit in a body by generating intersecting perforation holes including plasma for conducting electrical energy from a power source.

32 Claims, 6 Drawing Sheets

U.S. PATENT DOCUMENTS

| | | | |
|---|---|---|---|
| 6,926,080 | B2 | 8/2005 | Khomynets |
| 7,121,340 | B2 | 10/2006 | Grove |
| 7,165,614 | B1 | 1/2007 | Bond |
| 7,225,740 | B1 | 6/2007 | Wood |
| 2002/0189482 | A1 | 12/2002 | Kneisl |
| 2004/0255812 | A1 | 12/2004 | Bourne |
| 2006/0003152 | A1 | 1/2006 | Youngs |
| 2006/0038160 | A1 | 2/2006 | Wood |
| 2006/0266551 | A1 | 11/2006 | Yang |
| 2007/0005646 | A1 | 1/2007 | Dumais |
| 2007/0018894 | A1 | 1/2007 | Wood |
| 2007/0044674 | A1 | 3/2007 | Wood |
| 2007/0051267 | A1 | 3/2007 | Meddes |

FOREIGN PATENT DOCUMENTS

| | | | |
|---|---|---|---|
| WO | 2005/035940 | A1 | 4/2005 |
| WO | 2006/054052 | A1 | 5/2006 |
| WO | 2006/054081 | A1 | 5/2006 |

* cited by examiner

METHODS AND SYSTEMS FOR GENERATING AND USING PLASMA CONDUITS

FIELD

An apparatus and method are disclosed for generating and using plasma conduits.

BACKGROUND

Electromagnetic energy can be used to sense or affect objects from a distance. One application is the stimulation of crude oil reservoirs for oil production.

Various methods have been developed for recovery of residual oil. For example, U.S. Pat. No. 2,799,641 discloses the use of direct current to stimulate an area around a well, and using electro-osmosis for oil recovery. Another example of electro-osmosis is described in U.S. Pat. No. 4,466,484, wherein direct current is used to stimulate a reservoir.

U.S. Pat. No. 3,507,330 discloses a method for stimulating the area near a well bore using electricity passed upwards and downwards in the well using separate sets of electrodes. U.S. Pat. No. 3,874,450 discloses a method for dispersing an electric current in a subsurface formation by an electrolyte. U.S. Pat. No. 4,084,638 discloses high-voltage pulsed currents in two wells to stimulate an oil-bearing formation.

U.S. Pat. No. 6,427,774 teaches recovering oil soil and rock formations using pulsed electro-hydraulic and electromagnetic discharges that produce acoustic and coupled electromagnetic-acoustic vibrations.

SUMMARY

A system is disclosed which comprises a plasma conduit maintaining ionized particles within a perforation hole in a body, and a power source configured to provide electrical power through the plasma conduit.

A method is disclosed which includes detonating a plasma generator, the detonation forming a plasma conduit within a body perforation hole, and connecting a power source to the plasma conduit, the power source configured to provide electrical power through the plasma conduit.

A system is also disclosed for generating a plasma conduit. The system comprises two or more explosive devices containing ionizable material. The explosive devices are adapted to, upon detonation, form a plasma conduit in a body by generating intersecting perforation holes including plasma for conducting electrical energy from a power source.

DETAILED DESCRIPTION

Figure 1:
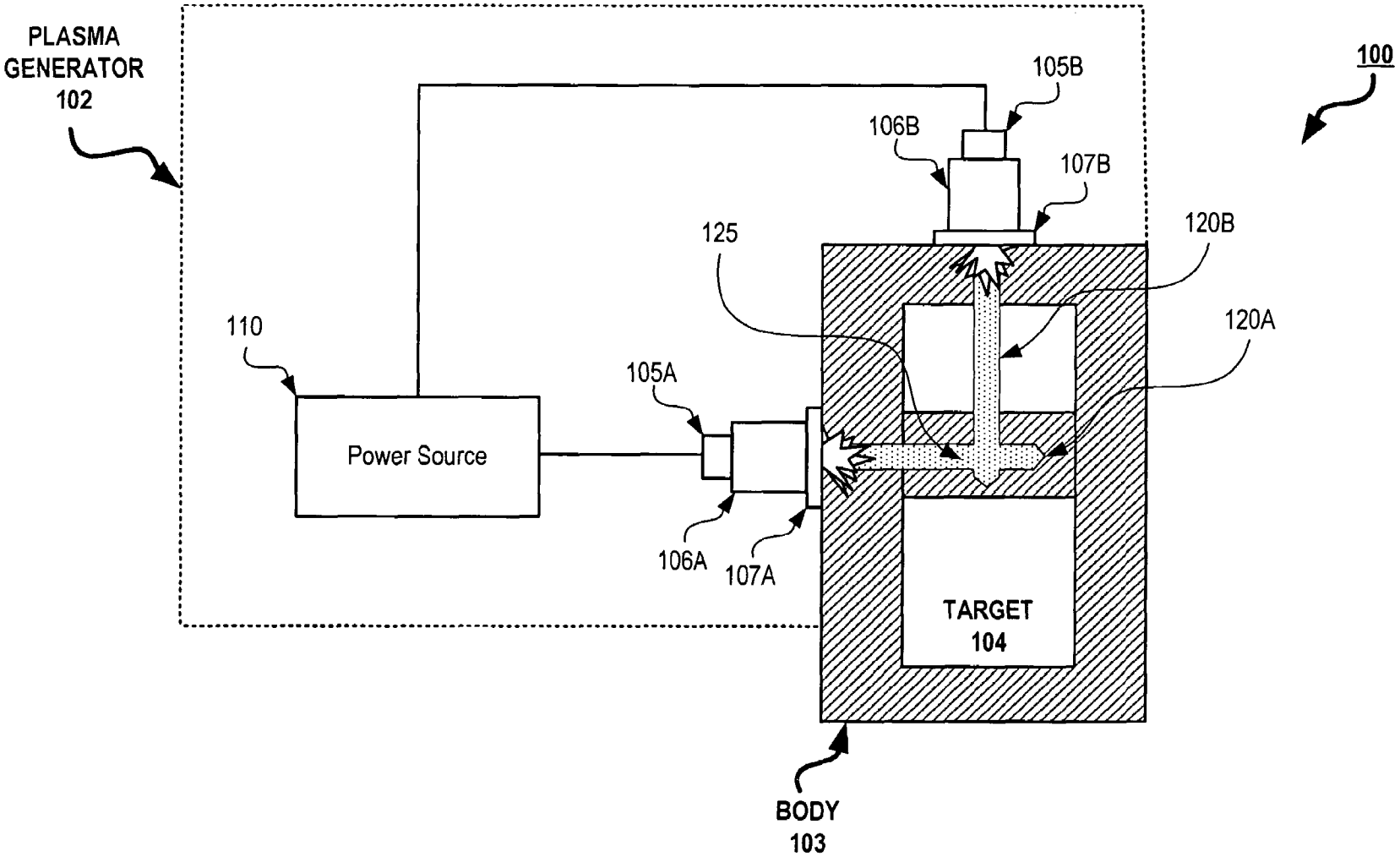
FIG. 1 is a block diagram illustrating an exemplary system environment as disclosed herein.

FIG. 1 is a block diagram illustrating an exemplary system 100 that includes plasma generator 102 for forming a plasma conduit 125 that maintains ionized particles within a perforation hole 120 in a body 103 and a power source 110 configured to provide electrical power through the plasma conduit 125.

Plasma generator 102 can be a device operable to create plasma conduit 125, which is comprised of a plasma of ionized material. A plasma conduit 125 contains plasma with a free electron density such that electrical energy can be conducted or guided to do useful work. As shown in FIG. 1, plasma generator 102 may include detonators 105A & 105B (collectively, detonators 105), explosive devices 106A & 106B (collectively, explosive devices 106), conducting plates 107A & 107B (collectively, conducting plates 107), and power source 110.

Plasma generator 102 may include two or more explosive devices 106 containing ionizable material. Upon detonation, explosive devices 106 can form plasma conduit 125 in body 103 by generating intersecting perforation holes 120 including plasma for conducting electrical energy from power source 110. For instance, explosive devices 106 may include materials that, when detonated, propel and impart heat to the ionizable material sufficient to achieve at least the ionizing temperature of the material. As particles of the material are ionized, a plasma (i.e., conductive fluid) is produced including ions and free electrons propelled by the explosion of explosive devices 106.

Explosive devices 106 can be high-detonation velocity explosive materials. Examples of suitable materials include, but are not limited to, cyclotetramethylene-tetranitramine (HMX), HMX blended with another explosive material (i.e., an "HMX blend"), cyclotrimethylenetrinitramine (RDX), RDX blended with another explosive material (i.e., an "RDX blend"), an HMX/estane blend (e.g., LX-14), or the like.

Explosive devices 106 can be shaped-charges, which include an explosive shaped in such a way that the energy of the detonated explosive is directed. The explosion can be channeled or formed into a "jet" of liner material in selected directions. For instance, a cylindrical shaped charge can be detonated in the center of a cylinder to create two high-velocity jets in opposite directions.

The ionizable material can be formed in a liner (not shown) that is disposed on or proximate to a forward face of explosive devices 106. The ionizable material can be made from any material capable of being ionized as a result of aerodynamic heating induced by being propelled by the explosive charge. In some embodiments, the ionizable material can be made of one or more alkali metals, can be made of a compound of one or more alkali metals (e.g., alkali salts, alkali carbonates, and the like), or can be a constituent of a compound of one or more alkali metals. Alkali metals include lithium, sodium, potassium, rubidium, cesium, and francium. Further, the ionizable material can be mechanically combined with another material; for example, the ionizable material may comprise particulates within another material or may comprise a layer affixed to another material.

In other embodiments, the ionizable material can be a component of a clathrate, in which particles of the ionizable material can be trapped within the crystal lattice of another material. The liner may also include other materials, such as copper, a copper alloy, a ceramic or other material suitable for shaped charge liners.

In still other embodiments, the liner material can be a coruscative compound that, when explosively compressed, detonates and forms solid or liquid detonation products without gas detonation products. This so-called "heat reaction" can liberate several times the amount of energy density of the explosive that initiates the coruscative detonation.

Coruscative compounds include metal and carbon-based mixtures and/or alloys of metal and carbon-based materials that undergo a "non-outgassing" reaction at elevated temperatures of at least 2500 degrees Celsius (±10%); particularly, at least 3000 degrees Celsius (±10%); and more particularly, at least 4000 degrees Celsius (±10%). Exemplary coruscative compounds include, but are not limited to, carbon powder with titanium powder, carbon powder with zirconium powder, carbon powder with hafnium powder, tantalum powder with carbon powder, and the like. Note that the carbon powder in the exemplary compounds provided above can be replaced with boron powder. In one such example, liner may comprise tantalum powder with boron powder, resulting in a lighter weight liner with similar energy released at detonation, as compared to liner comprising tantalum powder with carbon powder.

Power source 110 can be connected to the detonator 106 for providing power to detonators 105 to detonate explosive devices 106 and, subsequent to detonation, power source 110 may supply power to power conduit 125 via conductive plates 107. Power source 110 can be any type of electrical power supply for providing voltage or current. Power source 205 can include rotating machines, gas impulse generators, and other pulse power systems. Alternatively, power source 205 can be an alternating-current power supply for providing a substantially continuous current to power conduit 125. For example, power source 205 can be a switching power supply, which can be a single-phase or multi-phase source operating at various frequencies (e.g., 60 hertz). Furthermore, power source 205 may a portable system; for example, carried within a truck or, alternatively, by a person.

Even though FIG. 1 shows a single power source 110 for detonating explosive devices 106 and supplying plasma conduit 125, power source 110 may be separate devices configured to perform these respective functions.

As an example, power source 110 can be an electromagnetic pulse generator for providing pulsed power to body 104 via plasma conduit 125. The energy can be coupled to body 104 by current paths through conductive regions in body 103 that are established by plasma connection via conduits 125. For the case of low conductivity materials in body 103, the intersection of plasma in perforation holes 120 can provide a current path creating magnetic fields that couple into body 103.

Body 103 can be any solid object and can optionally include target 104, which can be a substance or object within body 103. In some exemplary embodiments, body 103 can be a portion of the ground. For instance, body 103 can be a mineral formation around a borehole of an oil well, and target 104 can be a pocket of oil within the formation. In other exemplary embodiments, body 103 can be a structure such as a building, or vehicle and target 104 may be a room in the building, a compartment of the vehicle, or a device therein.

As shown in FIG. 1, upon detonating the explosive devices 106, the plasma is propelled by the explosive force through conducting plates 107, into body 103, and potentially target 104. As the particles included in explosives 106 are heated by friction resulting from the detonation, the ionizable material is ionized into plasma. Ionization may occur when the alkali metals are raised to a gas phase due to heat from the exothermic reaction of the coruscatives, or due to a combination of heat and pressure due to the liner collapse and subsequent coruscative reaction under pressure and or friction. The free ions and electrons in the plasma may act as plasma conduit 125 that conducts current from a power source to perform useful work in body 103 and/or target 104.

Although plasma conduit 125 is illustrated as having substantially cylindrical form, plasma conduit 125 need not be cylindrical. Depending on a particular application or environment, explosive devices 106 can be configured to produce a plasma conduit 125 having other forms, such as intersecting planar forms. In addition, although the portions of plasma conduit 125 are shown intersecting at perpendicular angles, plasma conduit 125 can be oriented at any crossing angle.

Figure 2A:
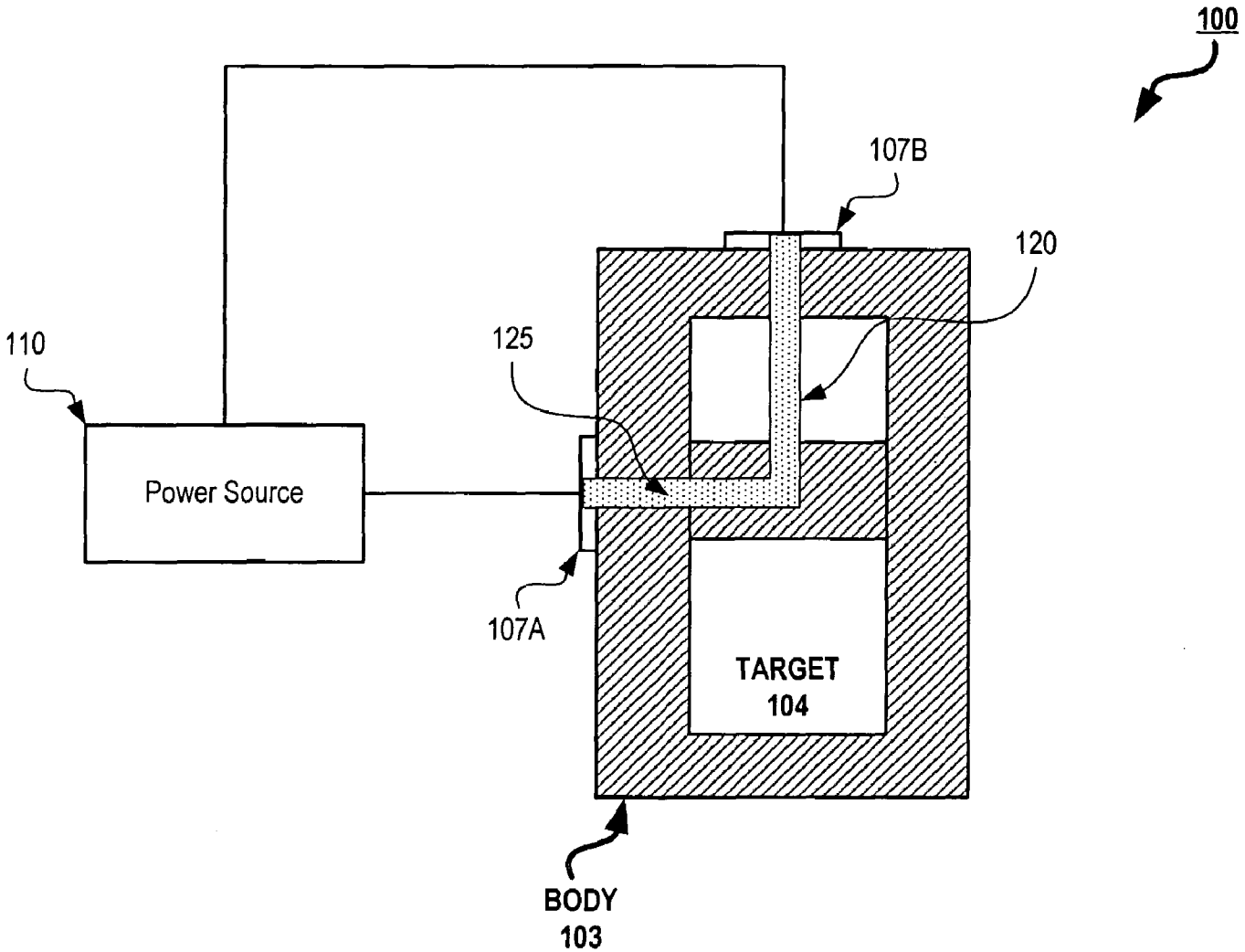
FIGS. 2A & 2B are block diagrams illustrating an exemplary embodiment as disclosed herein.

FIG. 2A shows an exemplary embodiment in which, after generation of plasma conduit 125 by detonation of explosive devices 106, power source 110 is electrically connected to plasma conduit 125 via conducting plates 107. Detonation of explosive devices 106 perforates conductive plates 107, body 103 and, potentially, target 104. Conductive plates 107 enclose plasma conduit 125, including the conductive fluids of ionized material produced by the explosion, in perforated holes 120A & 120B (collectively, perforated holes 120) and provide conductive contacts to connect power source 110 or other devices. Accordingly, plasma conduit 125 is maintained in intersecting perforation holes 120 and can conduct current through body 103, and optionally to target 104.

Although the explosion of explosive devices 106 occurs in an instant, plasma conduit 125 provides an electrical path that can be maintained over an extended period of time. That is, so long as the ionized particles stay substantially enclosed within perforation holes 120 and sufficient power is provided to the plasma to overcome cooling (e.g., due to heat transfer into surroundings), the plasma conduit 125 may be maintained.

In an exemplary application consistent with FIG. 2A, one or more plasma conduits 125 can be created around the bore hole of an oil well using a perforator gun including one or more plasma generators 102 disposed within the gun in directions for creating a number of intersecting perforation holes 120. By discharging the perforator gun, one or more separate plasma conduits 125 can be created in perforation holes 120 in the ground below the surface. As noted above, plasma conduits 125 may remain long after detonation of explosive devices 106 and, therefore, can be used to carry current to assist in oil recovery operations.

Electrical power driven through plasma conduit 125 by power source 110 may achieve various advantages, such as causing vitrification of the formation minerals along and around each perforation hole 120 in formation to prevent collapse. The electrical current can also generate eddy currents in the formation that in turn generate magnetic forces between the formation volume containing the induced currents and the plasma conduit 125 established currents. This repulsion manifests as a differential pressure gradient across and around plasma conduit 125 and the forms eddy current streamlines. The resulting pressure differences can do useful work in fracturing and establishing flow to improve the quality of perforation hole 120 or otherwise enhance flow or product from and through a formation.

Figure 2B:
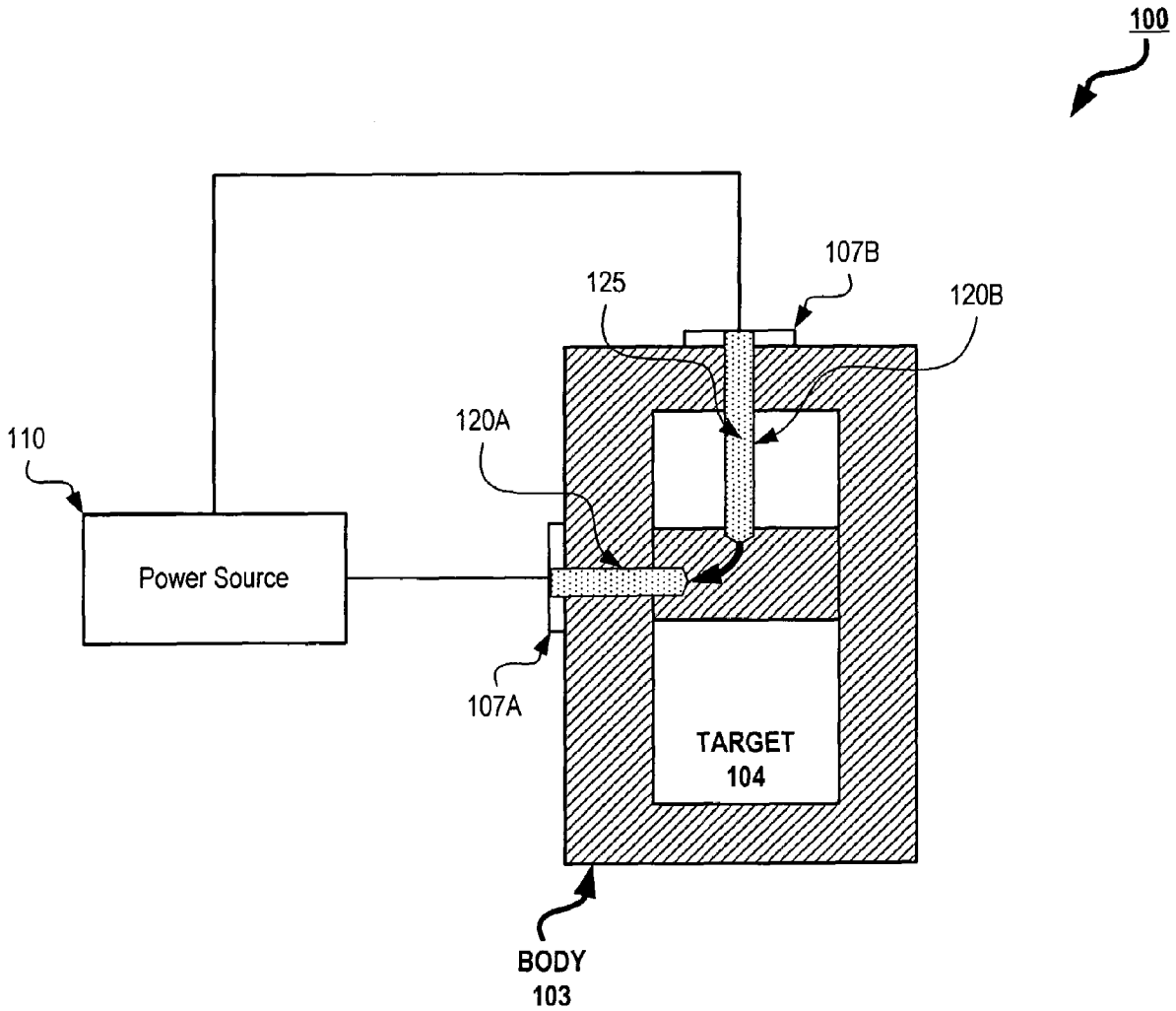

FIG. 2B illustrates an alternate embodiment in which perforation holes 120A & 120B do not physically intersect. Regardless of the lack of direct electrical contact between perforation holes 120A & 120B of plasma conduit 125, a complete electrical circuit may still be formed through a conductive portion of body 103 and/or target 104. For instance, a portion of a building, such as an I-beam may complete the circuit including plasma conduit 125 by conducting current between perforation holes 120.

The current conducted through body 103 and/or target 104 can be useful in upsetting or disabling electric and electromechanical devices inside the building. For instance, the current established in a metal beam, plumbing, ductwork, or other conductive structures may generate magnetic fields that magnetically couple and induce currents in adjacent materials and devices, which can be useful in transferring energy into adjacent volumes to perform useful work. Alternatively, as in the example above, when the plasma conduit is formed below the surface of the ground around a well borehole, oil or other liquids may complete a circuit including plasma conduit 125.

The magnetic fields generated by current flowing through plasma conduit 125 can also be used to inductively power a magnetic device, which could be a motor or actuator, to do useful work. For instance, to free a tool stuck in a well casing by generating magnetic force and/or differential pressures through magnetically coupling with the stuck tool.

Figure 3A:
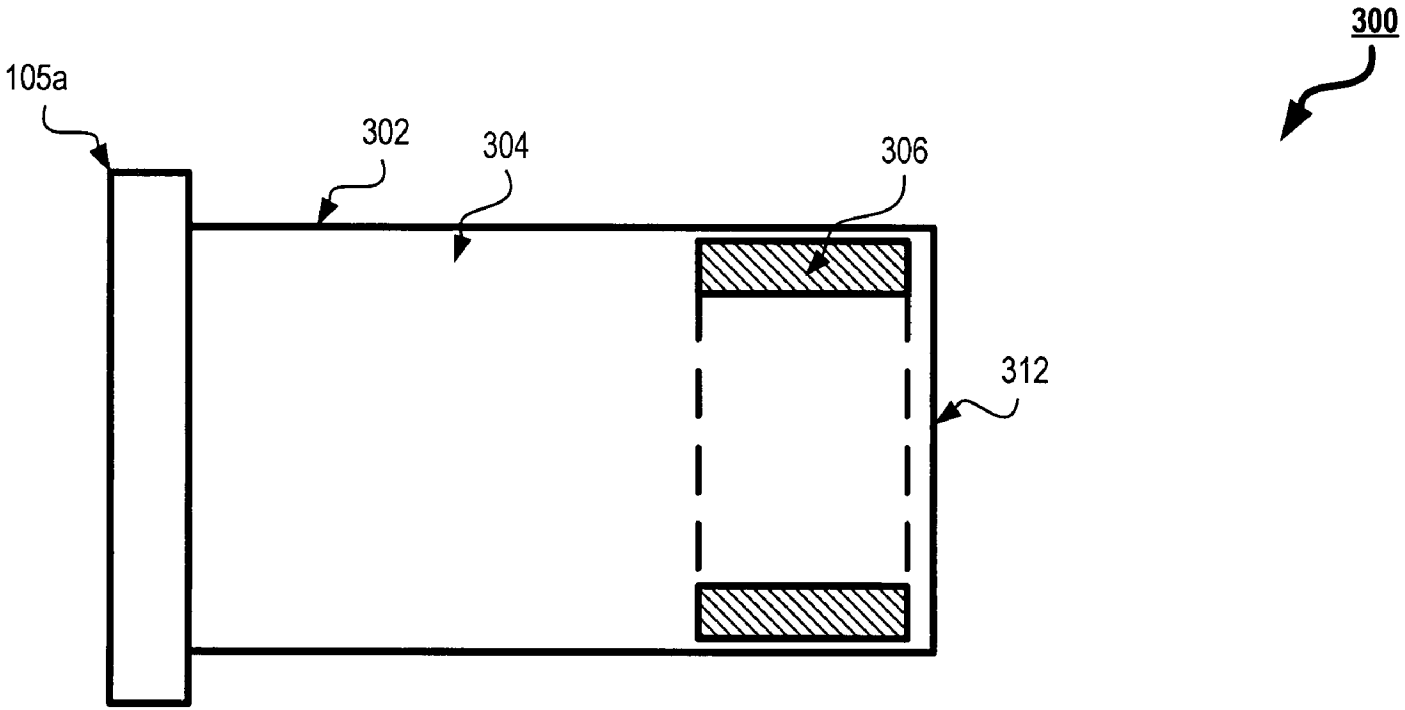
FIG. 3A illustrates an exemplary shaped charge plasma generator.

FIG. 3A illustrates a cross-sectional view of an exemplary detonator 105*a* adjacent to an exemplary shaped charge explosive device 300 including fluorine-bearing materials 306 that can create a plasma conduit 125. The plasma conduit 125 can have a quenched, low-conductance layer of plasma in a portion of plasma conduit 125 adjacent to the origin of perforation hole 120 where plasma conduit 125 exchanges power with power source 205. Explosive device 300 includes a container 302, a coruscative material 304, and a fluorine bearing material 306. Container 302 contains the fluorine-bearing material 306 and the coruscative material 304 and has an opening 312 to vent released fluorine gas from the fluorine-bearing material 306 when the fluorine-bearing material 306 is at or above a first temperature. The coruscative material 304 is positioned within the container 302 at least partially adjacent to the fluorine bearing material 306. The position of the coruscative material 304 with respect to the fluorine bearing material 306 is such that the heat generated by a reaction of the coruscative material 304 is sufficient to raise a temperature of the fluorine bearing material 306 to or above the first temperature; for example, that temperature at which fluorine-bearing material 306 releases the absorbed fluorine gas. For some nickel-based alloys, this first temperature is at least 350 degrees Celsius.

Figure 3B:
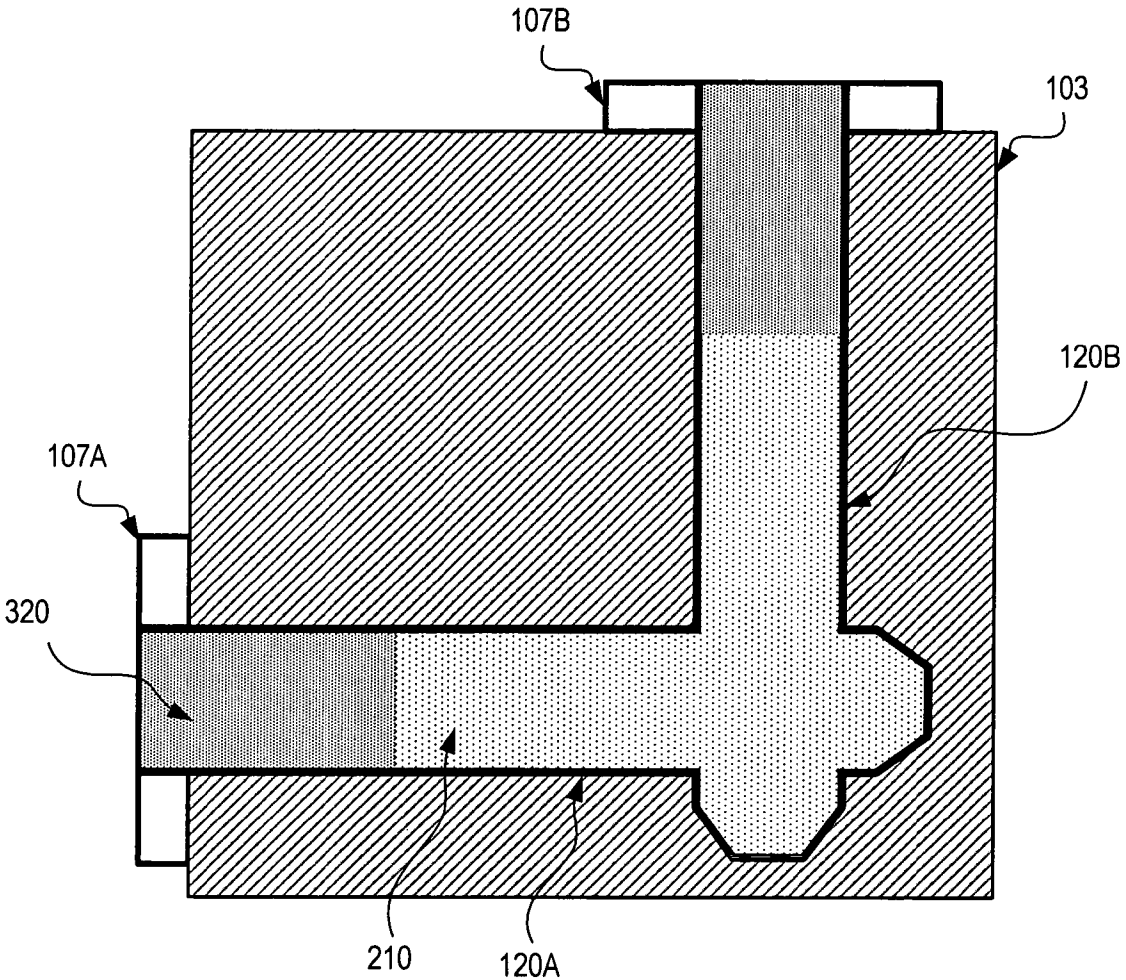
FIG. 3B illustrates an exemplary plasma conduit.

FIG. 3B illustrates an exemplary plasma conduit 125 generated by explosive device 300. The fluorine gas released by fluorine-bearing material 301 provides a low-conductance layer 320 in portions of plasma conduit 125 around the origin of perforation holes 120 where the conduit connects to power source 205 via conducting plates 107. The low-conductance layer enhances current flow to the center of plasma conduit 125, as well as providing a low-impedance path from the conductive plate 107, which is substantially covered with the plasma of plasma conduit 125. In some exemplary embodiments, fluorine-bearing materials 306 are arranged in shaped charge explosive device 300 to provide a low-conductance layer of plasma that extends approximately one-third of the length of plasma conduit 125 from the conduit's origin. The remaining approximately two-thirds of plasma conduit does not include the fluorine gas. Of course, plasma generator 300 may be configured to produce low-conductance region that is longer or shorter; and the conductance of the region may also be varied.

Figure 4:
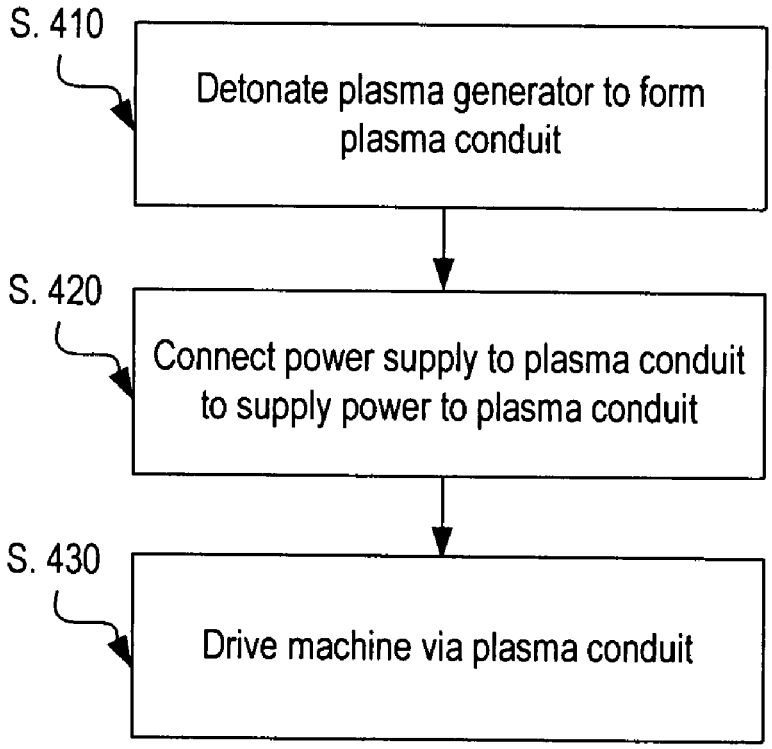
FIG. 4 is a flow diagram illustrating an exemplary method as disclosed herein.

FIG. 4 illustrates an exemplary method including detonating plasma generator 102 to form plasma conduit 125 within a perforation hole 120 in body 103, and connecting power source 110 to plasma conduit 125, the power source 110 being configured to provide electrical power through plasma conduit 125. The method includes detonating explosive devices 106 (or 300) in plasma generator 102 to form intersecting perforation holes 120 containing ionized material through both conductive plates 107, body 103 and, potentially, target 104 (step 410). For instance, one or more oil perforator guns including many plasma generators 102 can be disposed at angles adjacent to body 103 in positions such that their respective the plasma perforate and intersect within body 103. The intersecting perforation holes 120 can be linked to form one or more plasma conduits 125 inside body 103. The linking between perforation holes 120 can be direct, or it can be through a portion of body 103 and/or target 104.

Conductive plates 107 can be in contact with and substantially covering the conductive plasma conduit 125. Thus, plasma conduits 125 can be connected to power source 110 using conductive plates 107 to supply electrical power to plasma conduit 125 (step 420). Power source 205 may generate a voltage difference across conductive plates 107 perforated by plasma generator 102 causing current to flow through the plasma conduit 125.

The power supplied through plasma conduits 125 can be used to operate a machine (step 430). For instance, a casing plug seal assembly, normally operated by energy transferred down the well bore by hydraulic or mechanical means, incorporates a fail-safe magnetic decoupling actuator. The magnetic circuit in the actuator can be connected to the plasma conduits in the event the tool becomes stuck in the well bore. The plasma generators and connections to power supply preferably located just above the plug seal tool assembly. Alternatively, the conduits 125 can be used to carry destructive energy, such as an electromagnetic pulse, to disrupt or disable electromechanical devices in a structure.

The particular embodiments disclosed above are illustrative only, as the invention can be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above can be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A system, comprising:

a plasma generator having at least one explosive device including an ionizable material, wherein, a detonation of the at least one explosive device generates a perforation hole in a body and ionizes the ionizable material into ionized particles, the perforation hole forming a plasma conduit that maintains the ionized particles within the perforation hole in the body; and wherein the system comprises a power source configured to provide electrical power through a circuit comprising the ionized particles of the plasma conduit.

2. The system of claim 1, wherein the plasma conduit includes a low-conductance layer of plasma formed in at least one portion of the plasma conduit adjacent to where the power source provides electrical power.

3. The system of claim 1, wherein the detonation of the explosive device causes the ionizable material to project in the perforation hole in a direction substantially along an axis.

4. The system of claim 3, wherein the plasma generator includes:

a first source of electrically conductive fluid; and a second source of electrically conductive fluid, wherein the first source and the second source are oriented such that, in operation, the electrically conductive fluid generated by the first source intersects the electrically conductive fluid generated by the second source.

5. The system of claim 3, wherein the ionizable material includes:

a material selected from the group consisting of: an alkali metal, a compound of an alkali metal, a constituent of the compound of the alkali metal, a clathrate of an alkali metal, a constituent of the clathrate of the alkali metal, an intercalation compound of an alkali metal, and a constituent of the intercalation compound of the alkali metal.

6. The system of claim 3, wherein the plasma generator includes one or more fluorine-bearing materials formed in a ring.

7. The system of claim 3, wherein each of the at least one explosive device includes:

a corresponding conductive plate, wherein the power source is linked to the plasma conduit via the conductive plate.

8. The system of claim 3, wherein the at least one explosive device includes:

a housing defining a plurality of openings; and a plurality of shaped charge devices received in the openings.

9. The system of claim 8, wherein the housing is an oil perforator gun.

10. The system of claim 1, wherein the power source is an electromagnetic pulse generator.

11. The system of claim 1, wherein the power source is an alternating-current source.

12. The system of claim 1, wherein the power source includes a rotating machine delivering current to the circuit including the plasma conduit.

13. The system of claim 1, wherein the plasma conduit is formed in intersecting perforations around a borehole.

14. The system of claim 1, wherein the plasma conduit conducts current through a structure.

15. The system of claim 14, wherein at least part of the structure is included in the circuit.

16. A method, comprising:

detonating a plasma generator, the detonation generating a perforation hole in a body and ionizing the ionizable material into ionized particles, the perforation hole forming a plasma conduit that maintains the ionized particles within the perforation hole in the body; and connecting a power source to the plasma conduit, the power source configured to provide electrical power through the plasma conduit.

17. The method of claim 16, wherein the detonation projects the ionizable material in the perforation hole in a direction substantially along an axis.

18. The method of claim 17, wherein the forming of the plasma conduit includes:

forming a low-conductance layer of plasma in at least one portion of the plasma conduit adjacent to where the plasma conduit connects to the power source.

19. The method of claim 16, wherein connecting the power source includes:

connecting a rotating machine in a circuit including the plasma conduit.

20. The method of claim 16, including:

generating an electromagnetic pulse in the power source; and providing the electromagnetic pulse to a circuit including the plasma conduit.

21. The method of claim 16, including:

generating alternating-current in the power source; and providing the alternating current to the circuit including the plasma conduit.

22. The method of claim 16, comprising:

operating a machine, at least in part, using the power provided through a circuit including the plasma conduit.

23. The method of claim 16, wherein the plasma conduit is formed in intersecting perforations around a borehole.

24. The method of claim 16, wherein the plasma conduit conducts current through a structure.

25. The method of claim 24, wherein a portion of the structure is included in the circuit.

26. A system for generating a plasma conduit, comprising:

two or more explosive devices containing ionizable material, the explosive devices being adapted to, upon detonation, form a plasma conduit in a body by generating intersecting perforation holes including plasma for conducting electrical energy from a power source.

27. The system of claim 26, wherein the two or more explosive devices are configured to project the plasma in a direction substantially along an axis.

28. The system of claim 26, wherein the ionizable material includes:

a material selected from the group consisting of: an alkali metal, a compound of an alkali metal, a constituent of the compound of the alkali metal, a clathrate of an alkali metal, a constituent of the clathrate of the alkali metal, an intercalation compound of an alkali metal, and a constituent of the intercalation compound of the alkali metal.

29. The system of claim 26, wherein the explosive device includes one or more fluorine-bearing materials formed in a ring.

30. The system of claim 26, wherein the two or more explosive devices include, for each explosive device, a corresponding conductive plate adapted to link a power source to the plasma conduit.

31. The system of claim 30, wherein the perforation holes include a low-conductance layer of plasma formed in at least one portion of the plasma conduit adjacent to the conductive plates.

32. The system of claim 26, wherein the two or more explosive devices are housed in an oil perforator gun.

* * * * *